313-414 SR
12/16/86 OR 4,629,933

United States Patent [19]
Bijma et al.

[11] Patent Number: 4,629,933
[45] Date of Patent: Dec. 16, 1986

[54] CATHODE-RAY TUBE HAVING AN ELECTRON GUN WITH AN ASTIGMATIC FOCUSING GRID

[75] Inventors: Jan Bijma; Jan Gerritsen, both of Eindhoven, Netherlands

[73] Assignee: U.S. Philips Corporation, New York, N.Y.

[21] Appl. No.: 603,056

[22] Filed: Apr. 23, 1984

[30] Foreign Application Priority Data

May 6, 1983 [NL] Netherlands ..... 8301601

[51] Int. Cl.[4] ..... H01J 29/62; H01J 29/50
[52] U.S. Cl. ..... 313/414; 313/448
[58] Field of Search ..... 313/414, 413, 412, 448, 313/449

[56] References Cited

U.S. PATENT DOCUMENTS

| | | | |
|---|---|---|---|
| 3,295,001 | 12/1966 | Burdick et al. | 313/448 |
| 3,852,608 | 12/1974 | Johanns et al. | 313/449 |
| 3,919,583 | 11/1975 | Hasker et al. | 313/414 X |
| 4,242,613 | 12/1980 | Brambring et al. | 313/448 X |
| 4,251,747 | 2/1981 | Burdick | 313/414 X |
| 4,358,703 | 11/1982 | Bijma et al. | 313/448 X |

FOREIGN PATENT DOCUMENTS

| | | | |
|---|---|---|---|
| 0084554 | 5/1982 | Japan | 313/414 |
| 0059534 | 4/1983 | Japan | 313/414 |

*Primary Examiner*—Palmer C. DeMeo
*Attorney, Agent, or Firm*—Robert J. Kraus

[57] ABSTRACT

A cathode-ray tube comprising in an evacuated envelope an electron gun for generating at least one electron beam which is focused on a display screen to form a spot and which is deflected in two mutually perpendicular directions so that a raster is written on the display screen. The electron gun comprises a cathode which is centered on an axis, a first grid at some distance therefrom along the axis and a second grid at some distance from the first grid, the first and second grids each having a part which is perpendicular to the axis and which comprises an aperture around the axis. The aperture in the first grid, on the side of the second grid, is elongate in a direction coinciding with one of the deflection directions and, on the side of the cathode, is elongate in a direction perpendicular to the elongate direction of the aperture on the side of the second grid. The dimensions and the depths of the portions of the aperture on the side of the second grid and on the side of the cathode are chosen so that, for the beam operating current range of the cathode-ray tube, substantially one crossover is formed in an astigmatically-focused electron beam, thereby improving near the second grid, spot quality.

8 Claims, 18 Drawing Figures

FIG.12a
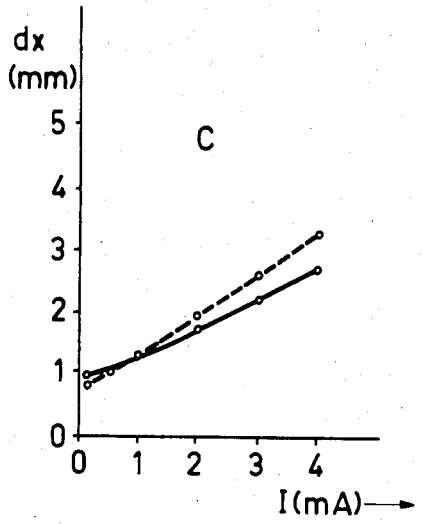
FIG.12b
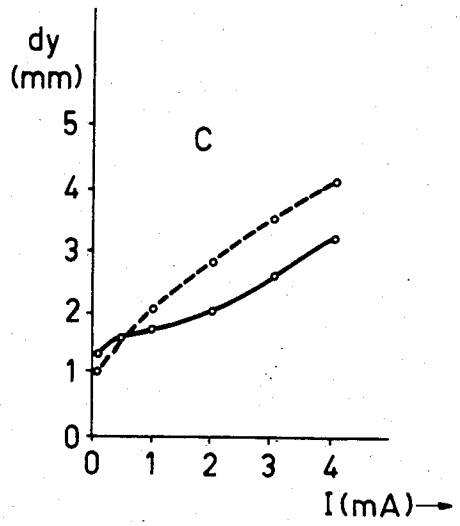
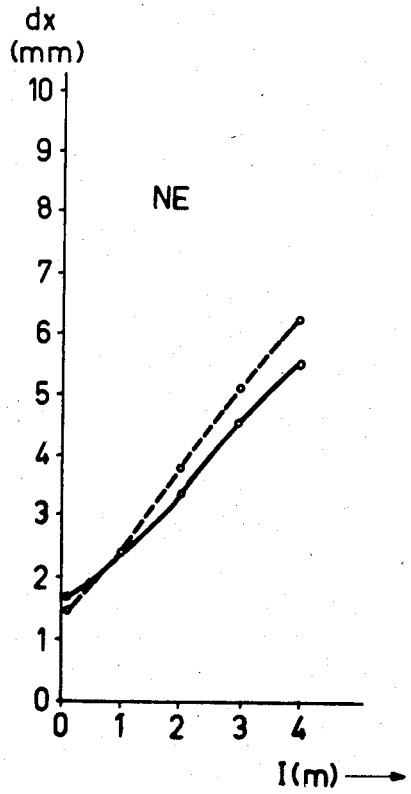
FIG.12c
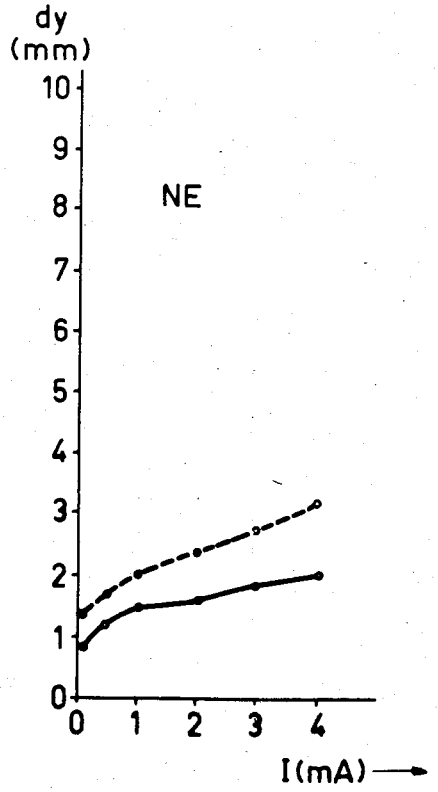
FIG.12d

CATHODE-RAY TUBE HAVING AN ELECTRON GUN WITH AN ASTIGMATIC FOCUSING GRID

BACKGROUND OF THE INVENTION

The invention relates to a cathode-ray tube comprising in an evacuated envelope an electron gun for generating at least one electron beam which is focused on a display screen to form a spot and which is deflected in two mutually perpendicular directions so that a raster is written on the display screen. The electron gun comprises a cathode which is centered on an axis, a first grid at some distance thereform along the axis and a second grid at some distance from the first grid. The first and second grids each have a part which is perpendicular to the axis and which has an aperture around the axis. The portion of the aperture in the first grid on the side of the second grid is elongate in a direction coinciding with a direction of deflection, and the portion of the aperture in the first grid on the side of the cathode is elongate in a direction perpendicular to the elongate direction of the aperture on the portion of the side of the second grid.

Such a cathode-ray tube may be used for displaying television pictures. It may be, for example, a colour display tube, a monochrome display tube, a display tube for displaying letters, digits and characters (a so-called Data-Graphic-Display tube or D.G.D.-tube) a projection television display tube or an oscilloscope tube. In all of these tubes, particularly at large beam currents, a spot is desired on the display screen which has small dimensions and a minimum of haze around the spot. This is necessary so as to be able to display sharply small details, for example letters, also in the corners of the display screen.

Such a cathode-ray tube is known from the U.S. Pat. Nos. 4,242,613 and 4,358,703 which may be considered to be incorporated herein. It is described in these patents that the haze around the spot on the display screen, also in the corners and at the edge, can be reduced considerably by means of a cathode-ray tube as described in the opening paragraph. By constructing the first grid as described, an astigmatically-focused electron beam is obtained, which is less deformed by the deflection coils, which produce an astigmatic electron lens. In a cathode-ray tube the spot of the electron beam on the display screen is the reproduction by means of one or more electron lenses of a cross-over which is present in the region between the first and the second grid. By constructing the first grid as indicated, not one cross-over is obtained, but the electron beam originating from the cathode is focused in two focal lines present at a distance from each other, and is then focused on the display screen to form a spot.

Another manner of improving the spot quality is to reduce the influence of spherical aberration. This manner is described in Netherlands patent application Ser. No. 8204185 (corresponding to U.S. patent application Ser. No. 544,169 filed Oct. 21, 1983) not yet laid open to public inspection, and which may also be considered to be incorporated herein. In the cathode-ray tube described in the above mentioned patent application, viewed in the direction of propagation of the electron beam, there are successively provided behind a cross-over an accelerating prefocusing lens, between the second and third grid of the electron gun, and a main focusing lens. The diameter of the aperture in the third grid (the second lens electrode) is smaller than twice the diameter of the aperture in the second grid (the first lens electrode) and the effective spacing S-eff between the second and third grid is smaller than 1 mm. S-eff is defined as the minimum of the function $-\Delta V/E(z)$. Herein, $\Delta V$ is the voltage difference between the third and the second grid and $E(z)$ is the electric field strength between the third and the second grid on the axis as a function of the place z on the axis. With such an electron gun a smaller spot is obtained with less haze than with guns according to the traditional construction at comparable beam currents. This is because the spherical aberration of the main focusing lens and the spherical aberration in the electron beam in the prefocusing lens compensate each other to a certain extent, as a result of which the electron gun as a whole produces less aberration. It is necessary to use a strong prefocusing lens which is situated in the correct location with respect to the cross-over. With such a prefocusing lens the boundary rays of the electron beam are bent inwardly in such manner that in the main focusing lens they are no longer boundary rays.

A third manner to improve the spot quality is described in Netherlands patent application Ser. No. 7902868 laid open to public inspection. This improvement is obtained by using a second grid which is thick as compared with the second grid of other guns, a strong electric field between the second and the third grid, and/or an increased object distance of the main focusing lens.

A fourth manner of improving the spot quality is described in German patent application Ser. No. 3130137 laid open to public inspection. This improvement is obtained by providing after the cross-over a delaying prefocusing lens so that the outermost electron rays of the electron beam form a second cross-over for the main focusing lens. As a result of this the spherical aberration of the beam in the main lens is reduced and a spot is obtained having small dimensions only at higher beam currents.

In the last-mentioned three manners of improving the spot quality the location of the cross-over with respect to the prefocusing lens is very critical. It is therefore not beneficial to use the first grid according to the U.S. Pat. No. 4,358,703 with which an astigmatically-focused electron beam having two focal lines instead of one cross-over is obtained, without further measures in the electron guns according to the last-mentioned three patent applications. If one of the focal lines has the correct location relative to the prefocusing lens, the other focal line does not, spot quality improvement occurs only in one direction. Nevertheless there exists a need for an astimagtically-focused electron beam. For example, in self-converging display tube systems having a large deflection angle (for example 110°) it is generally necessary, in order to avoid too much vertical haze in the corners of the display screen, to give the electron beam(s) in the deflection plane a smaller cross-section in a direction which coincides with the direction of deflection in which the deflection coils form a positive electron lens.

SUMMARY OF THE INVENTION

It is therefore an object of the invention to provide a cathode-ray tube having a first grid of the kind described in the opening paragraph, hence of the kind as described in U.S. Pat. Nos. 4,242,613 and 4,358,703, with which a combination with the other described aberration-reducing prefocusing measures does lead to a beneficial result and the whole spot quality is improved in all directions.

A cathode-ray tube of the kind described in the opening paragraph is for that purpose characterized according to the invention in that the dimensions and the depth of the portions of the aperture on the side of the second grid and on the side of the cathode are chosen to so that, for the beam operating current range of the cathode-ray tube, substantially one cross-over is formed in an astigmatically-focused electron beam near the second grid. The primary operating beam current range in a colour display tube is generally from 2 to 4 mA.

A first grid according to U.S. Pat. Nos. 4,242,613 and 4,358,703, as already stated, effects a pulling apart of the cross-over to form two focal lines. The focal line parallel to the longitudinal direction of the portion of the aperture in the first grid on the side of the second grid is situated nearer to the cathode.

An elongate aperture through the whole thickness of the first grid also results in a pulling apart of the cross-over in which the focal line parallel to the longitudinal direction of the aperture is also situated nearer to the cathode.

The invention is based both on the theoretically and the experimentally obtained recognition of the fact that by a suitable combination of aperture portions the effects of both portions can compensate each other and one cross-over can be obtained, however, while maintaining a difference in angular aperture of the electron beam in two mutually perpendicular directions from the cross-over.

A first preferred embodiment of the invention is characterized in that the cathode-ray tube is a colour display tube in which electron beams are generated by means of three electron guns situated with their axes in one plane. The plane extends in one of the deflection directions, and the portion of the aperture in at least one of the first electrodes, on the side of the second electrode, is elongate in a direction at right angles to the plane through the three gun axes. As a result of this the electron beam in the deflection plane in the deflection coils has a smaller dimension in one deflection direction. The deflection defocusing which is caused in that direction in the beam by the deflection coils, thus becomes less as a result of which the vertical haze around the spot in the corners of the display screen is reduced. By giving the electron beam a larger dimension in the other deflection direction, a reduction of the space charge repelling between gun and screen is obtained, as well as a smaller increase of the cross-over for the dimension situated in the deflection direction.

The length of the portion of the aperture in the first grid on the side of the cathode is preferably approximately equal to or smaller than the width of the portion on the side of the second grid.

Very good results are obtained if the portion of the aperture on the side of the cathode is rectangular. The corners of the rectangle, however, may also be rounded off or the portion may be oval. However, the aperture portion must always be sufficiently elongate and deep, with the longitudinal axis extending perpendicularly to the longitudinal axis of the aperture portion on the side of the second grid, that one cross-over is obtained.

The portion of the aperture in the first grid on the side of the second grid may be constructed in the manners as shown in the already mentioned U.S. Pat. Nos. 4,358,703 and 4,242,613. The portion of the aperture on the side of the second grid, however, is preferably rectangular.

If the aperture portion on the side of the second grid has a length of approximately 2 mm and a width of approximately 0.7 mm and the aperture portion on the side of the cathode has a length of approximately 0.7 mm and a width of approximately 0.5 mm, and if the first electrode has a thickness of approximately 0.3 mm, with the portion of the aperture on the side of the cathode having a depth of approximately 0.1 mm and the portion of the aperture on the side of the second grid having a depth of approximately 0.2 mm, a spot is obtained having a very small haze and small dimensions, as will be explained hereinafter. By varying the depths and adapting the lengths and widths of the aperture portions, other solutions can also be found in which substantially one cross-over is obtained in the beam current range of interest for the specific type of tube. These solutions can be determined and/or computed experimentally.

The invention may be used particularly beneficially in a cathode-ray tube in which the electron gun after the cross-over comprises a prefocusing lens and a main focusing lens, which prefocusing lens bends the boundary rays of the electron beam inwardly in such manner that in the main focusing lens they are no longer boundary rays.

BRIEF DESCRIPTION OF THE DRAWING

The invention will now be described in greater detail, by way of example, with reference to a drawing, in which.

DESCRIPTION OF THE PREFERRED EMBODIMENTS

Figure 1:
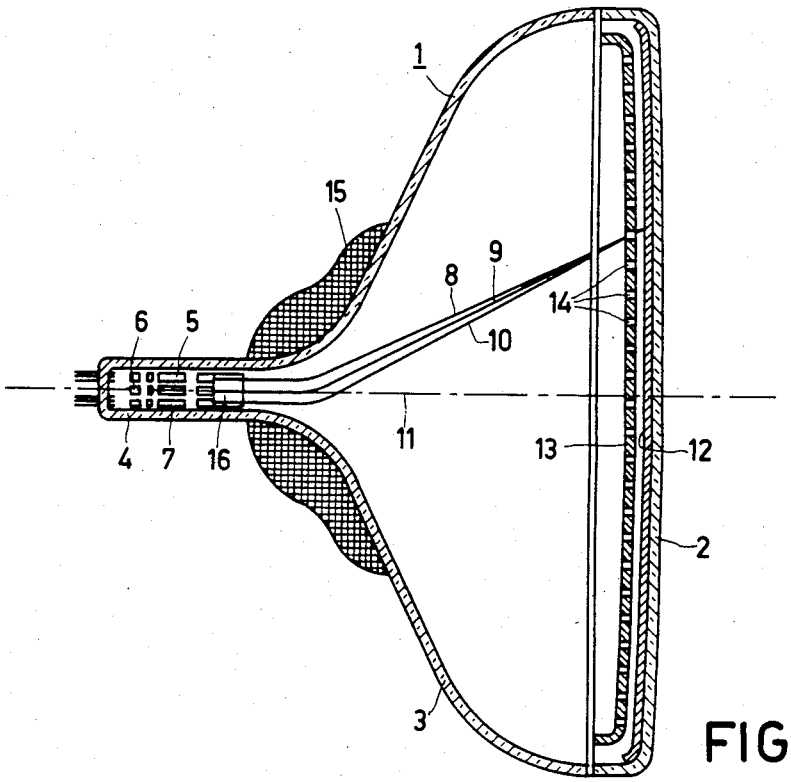
FIG. 1 is a horizontal sectional view through a cathode-ray tube according to the invention.

FIG. 1 is a diagrammatic horizontal sectional view through a cathode-ray tube according to the invention, in this case a colour display tube of the so-called "in-line" type. In a glass envelope 1 which is composed of a display window 2, a funnel-shaped part 3 and a neck 4, three electron guns 5, 6 and 7 are provided in the neck for producing electron beams 8, 9 and 10, respectively. The axes of the electron guns in a colour display tube of the "in-line" type are situated in one plane, in this case the plane of the drawing. The axis of the central electron gun 6 coincides substantially with the tube axis 11. The three electron guns open into sleeve 16, which is situated coaxially in the neck 4. The display window 2 on the inside has a large number of triplets of phosphor lines. Each triplet comprises a line consisting of a blue-luminescing phosphor, a line of a green-luminescing phosphor, and a line of a red-luminscing phosphor. All triplets together constiture the display screen 12. The phosphor lines are perpendicular to the plane of the drawing. A shadow mask 13 in which a very large number of elongate apertures 14 are provided parallel to the phosphor lines and through which the electron beams 8, 9 and 10 pass, is provided in front of the display screen. The electron beams are deflected in a horizontal direction (in the plane of the drawing) and in a vertical direction (at right angles to the plane of the drawing) by the system of deflection coils 15. The three electron guns are assembled so that their axes enclose a small angle with each other, thereby causing the electron beams produced to fall through the aperture 14 at the angle, the so-called colour selection angle, and to each impinge on only phosphor lines of one colour. The three electron guns 5, 6 and 7 as, for example, in U.S. Pat. No. 3,772,554, may have one or more electrodes in common. It will be obvious that the invention can also be used in such a so-called integrated electron gun system.

Figure 2:
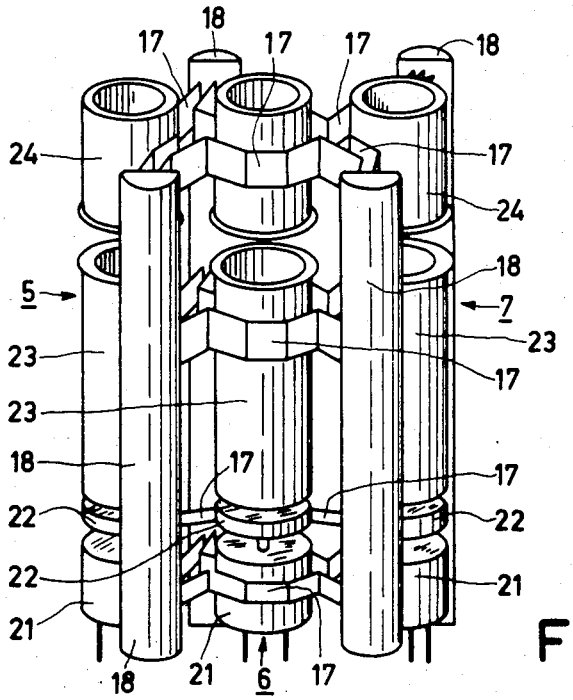
FIG. 2 is a perspective view of a three-fold electron gun system for a cathode-ray tube according to the invention.

FIG. 2 is a perspective view of the three electron guns 5, 6 and 7. The grids of the electron gun system are positioned relative to each other by means of metal strips 17, which are sealed in glass assembly rods 18. Each gun consists of a cathode (not visible), a first grid 21, a second grid 22, a third grid 23 and a fourth grid 24.

Figure 3:
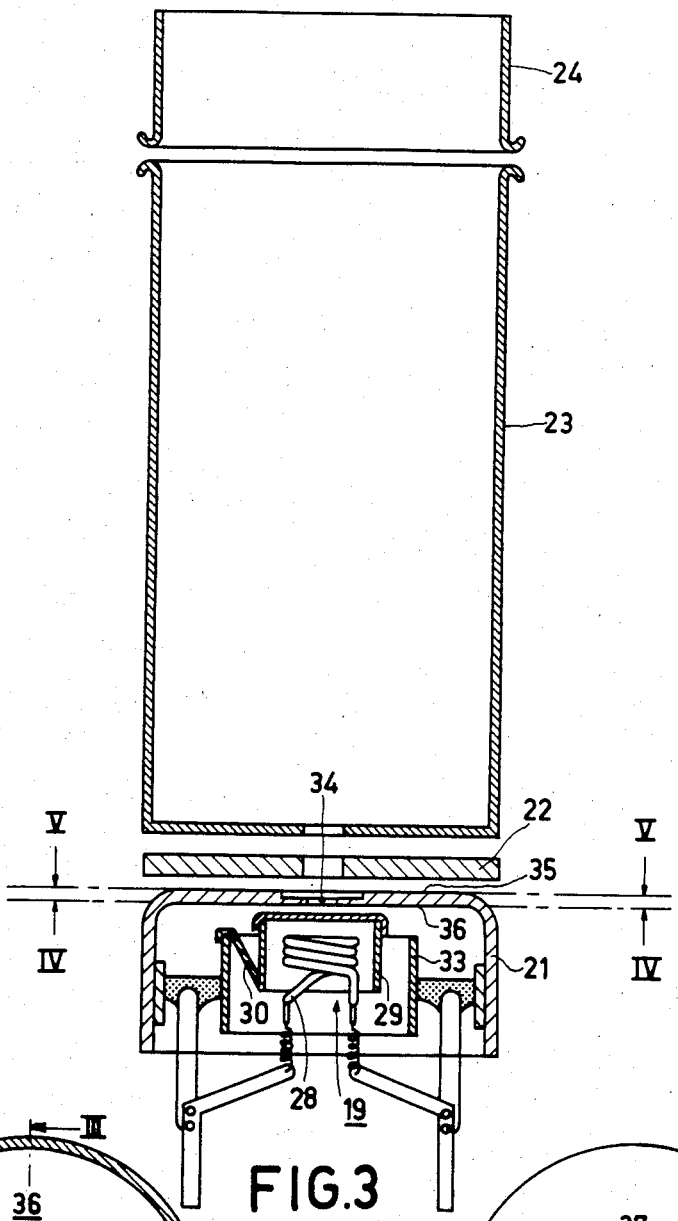
FIG. 3 is a longitudinal sectional view through one of the guns shown in FIG. 2, FIGS. 4 and 5 are sectional views of FIG. 3, FIGS. 6 to 9 show a number of preferred embodiments of the first grid, FIGS. 10*a, b, c* further explain the operation of the first grid, FIGS. 11*a* and *b* show the location and the shape of a number of observed spots obtained in a prior-art cathode-ray tube compared with a number of observed spots in a cathode-ray tube according to the invention, and FIGS. 12*a, b, c* and *d* are four graphs showing the spot dimensions in two mutually perpendicular directions obtained in a prior-art cathode-ray tube compared with the spot dimensions in a cathode-ray tube according to the invention at beam currents between 0.1 and 4 mA.

FIG. 3 is a longitudinal sectional view of one of the electron guns shown in FIG. 2. A rapidly heating cathode 19 is disposed in the first grid 21. A heating wire 28 is disposed in a cathode shank 29, which comprises an emission surface opposite the aperture portion 34 in the first grid 21. The cathode shank is connected to the supporting cylinder 33 by means of metal strips 30, which supporting cylinder is provided in the first grid so as to be electrically insulated.

Figure 4:
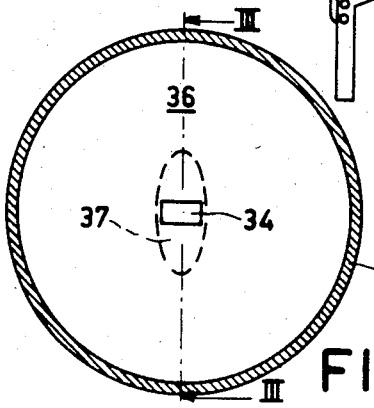

FIG. 4 is a sectional view through FIG. 3 viewed against the surface 36 of the first grid. The portion 34 of the aperture on this side, the cathode side, has a rectangular shape.

Figure 5:
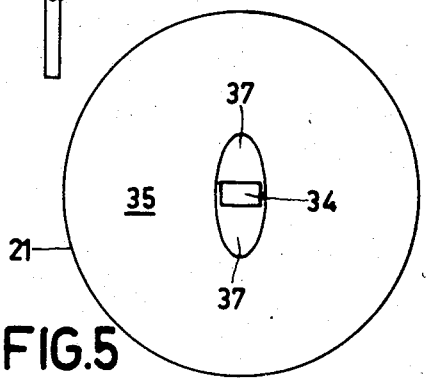

FIG. 5 is a sectional view of FIG. 3 viewed against the surface 35 of the first grid. On this side, the side of the second grid 22, the aperture portion has an elongate shape. This has been obtained by providing an oval pit 37 in the side of the grid, for example, by coining or etching.

Figure 6:
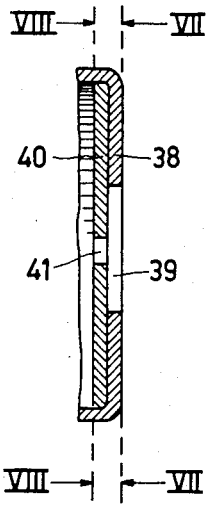
Figure 7:
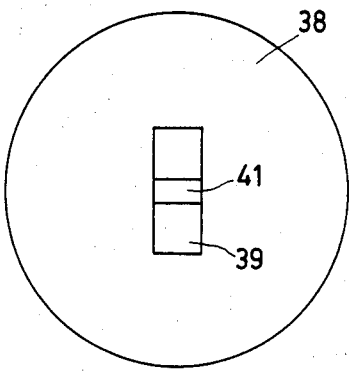
Figure 8:
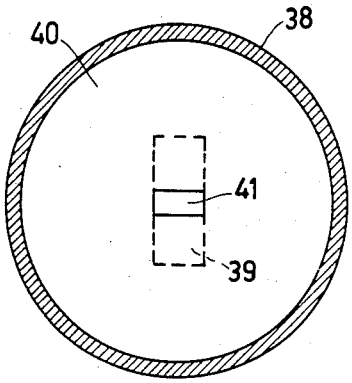

FIG. 6 is a sectional view of one embodiment of a first grid, as used in the cathode-ray tube according to the invention, which can be obtained in a simple and inexpensive manner. In this case the first grid consists of a plate-shaped part 38 having a rectangular aperture 39, as is also visible in FIG. 7, and a plate-shaped part 40 placed against it and having therein a rectangular aperture 41, as is also visible in FIGS. 7 and 8.

Figure 9:
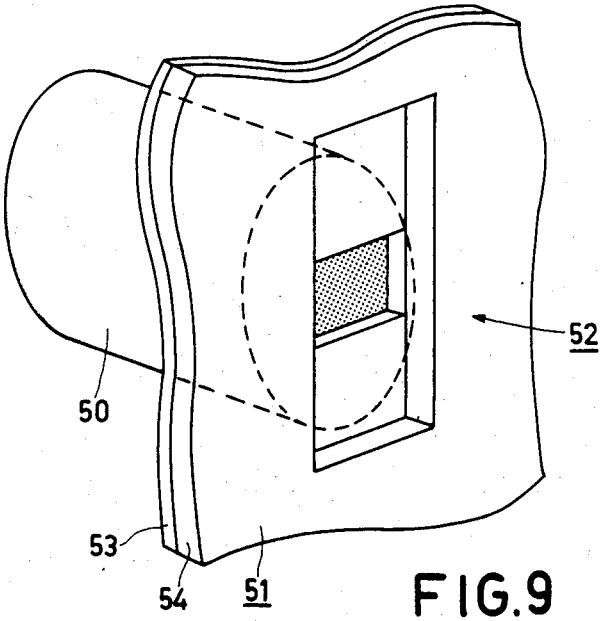

FIG. 9 is a perspective view of a cathode 50 having opposite thereto a part 51 of the first grid in which an aperture 52 is provided. The part 51, like the first grid of FIG. 6, is composed of two parts 53 and 54. Part 53 has a thickness of 0.1 mm and part 54 has a thickness of 0.2 mm so that part 51 is 0.3 mm thick. The aperture in part 53 is rectangular and is 0.5 mm wide and 0.7 mm long. The aperture in part 54 is also rectangular and is 2.1 mm long and 0.7 mm wide. Very good results were obtained with these dimensions for the apertures in the first grid. It will be obvious that it is possible that other readily workable solutions can be found by varying one of the dimensions and adapting the other dimensions.

Figure 10A:
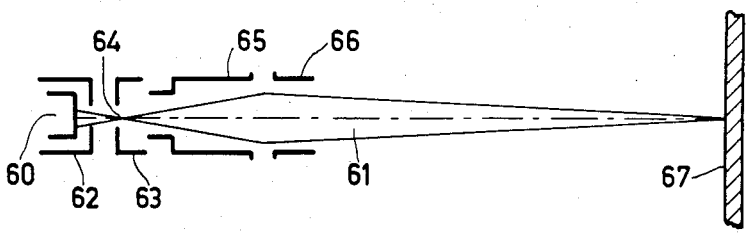

FIGS. 10*a*, *b* and *c* explain the operation of the first grid in a cathode-ray tube according to the invention. FIG. 10*a* is a diagrammatic sectional view through a conventional electron gun. The electron beam 61 originating from the cathode 60 passes through the first grid 62, is focused to form a cross-over 64 in the proximity of the second grid 63, and is then displayed on the display screen by a focusing lens formed by the grids 65 and 66.

Figure 10B:
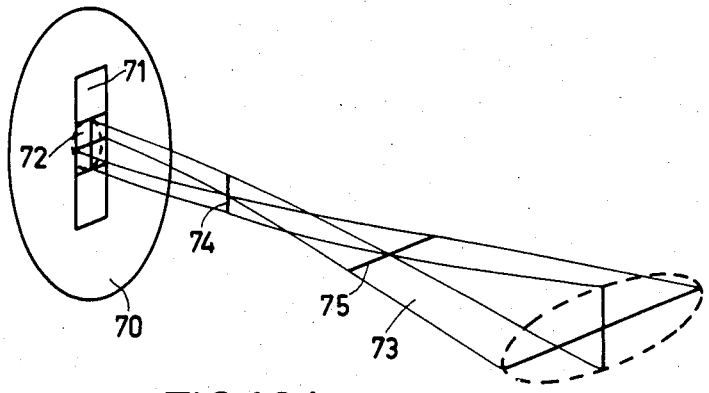

FIG. 10*b* shows the cross-over formation according to U.S. Pat. No. 4,358,703. The aperture in first grid 70 comprises an elongate portion 71 on the side of the second grid and a square portion 72 on the side of the cathode. This has for its result that the electron beam 73, of which only a few rays are shown, is not focused to form one cross-over, as is shown in FIG. 10*a*, but to form two focal lines 74 and 75.

Figure 10C:
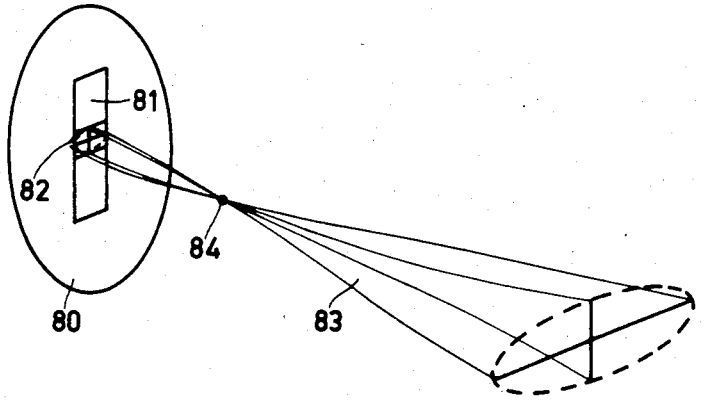

By providing the first grid 80 on the side of the second grid with an elongate aperture portion 81, as shown in FIG. 10*c*, and on the side of the cathode with an elongate aperture portion 82 the longitudinal axis of which is perpendicular to the longitudinal axis of the recess 81, an astigmatically-focused electron beam 83 with one cross-over 84 is obtained, in the beam current operating range of importance, with a correct choice of dimensions and depth of the elongate portions 81 and 82.

Figure 11A:
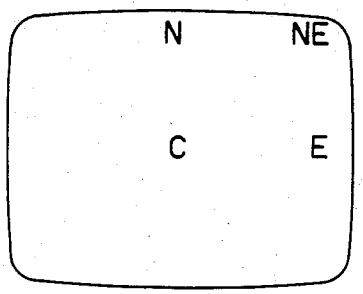

FIGS. 11*a* and *b* show a few experimental results. FIG. 11*a* shows a display screen of which C is the centre, N is a location at the upper edge, E is a location at the side edge and NE is a location in the corner.

Figure 11B:
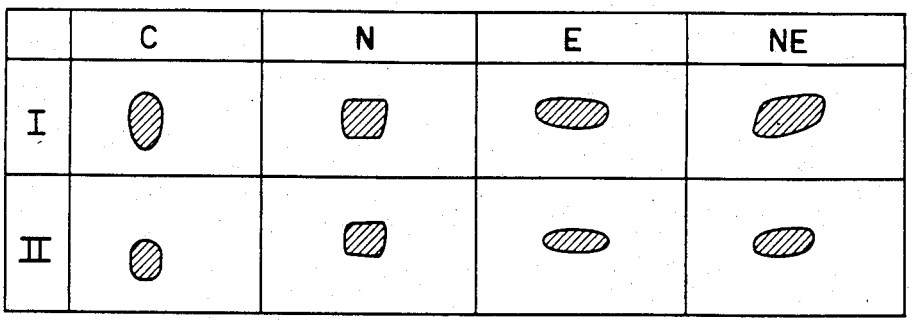

FIG. 11*b*, row I, shows on an enlarged scale a number of spots of the electron beam (at a beam current of 2 mA) which are observed in the places C, N, E, NE of the display screen in a prior-art tube having a first grid as described in U.S. Pat. No. 4,358,703 (which is a tube of the type 30-AX of Philips). Row II shows a number of spots, also at 2 mA beam current, which are observed in the locations C, N, E, NE of the display screen in a tube according to the invention in which a first grid is used with which one cross-over is obtained in an astimatically-focused electron beam. The spots in the tube according to the invention are considerably smaller.

In FIGS. 12*a* to *d* inclusive, the broken lines indicate the spot dimensions dx and dy (in mm) in the horizontal and vertical directions as a function of the beam current I (mA) in a prior-art 30-AX tube. The solid lines indicate, in an analogous manner, the spot dimensions dx and dy in a comparable tube according to the invention. The zeros indicate the measured values.

FIGS. 12*a* and *b* indicate the dimensions in the center of the display screen and FIGS. 12*c* and *d* indicate the dimensions in a corner of the display screen. From these Figures it follows that especially for large beam currents (in this case larger than 2 mA) the spot has become smaller especially in the vertical direction, which results in a much sharper picture.

What is claimed is:

1. A cathode ray tube comprising an envelope containing a display screen and an electron gun for producing an electron beam and focusing it onto a spot on the display screen for deflection in two perpendicular directions to form a raster, said electron gun comprising an arrangement of elements disposed along an axis of the electron gun, said arrangement successively including a cathode, a first grid and a second grid, said grids each having a part perpendicular to the electron gun axis and including an aperture for passing the electron beam;

characterized in that the aperture in the first grid comprises first and second elongate portions formed in opposite sides of the part perpendicular to the electron gun axis, the first portion being formed in the side of the part nearest the cathode and being elongate in one of the deflection directions, and the second portion being formed in the side of the part nearest the second grid and being elongate in the other deflection direction, the length, width and depth of the first and second portions being chosen to effect astigmatic focusing of the electron beam in respective first and second directions to a single cross-over point near the second grid, the length of the first portion being no larger than the width of the second portion, said single cross-over existing over the operating range of the electron beam current.

2. A cathode ray tube as in claim 1 comprising a color display tube including three electron guns situated with their axes in a common plane extending in one of the directions of deflection, the second aperture portion in at least one of the electron guns being elongate in a direction perpendicular to said plane.

3. A cathode ray tube as in claim 1 or 2 where the first aperture portion is rectangular.

4. A cathode ray tube as in claim 3 where the second aperture portion is rectangular.

5. A cathode ray tube as in claim 4 where the second aperture portion has a length of approximately 2 millimeters and a width of approximately 0.7 millimeters, and where the first aperture portion has a length of approximately 0.7 millimeters and a width of approximately 0.5 millimeters.

6. A cathode ray tube as in claim 5 where the apertured part in the first grid has a thickness of approximately 0.3 millimeters, the first portion of the aperture therein having a depth of approximately 0.1 millimeters and the second portion of said aperture having a depth of approximately 0.2 millimeters.

7. A cathode ray tube as in claim 1 where the apertured part in the first grid comprises first and second adjacent plates, the first portion of the aperture being formed in the first plate and the second portion of the aperture being formed in the second plate.

8. A cathode ray tube as in claim 1 or 2 where the arrangement of elements disposed along the electron gun axis further includes, in succession after the cross-over, electrodes for forming a prefocusing lens and a main focusing lens, said prefocusing lens effecting bending of boundary rays of the electron beam inwardly before they reach the main focusing lens.

* * * * *